United States Patent [19]

Hallam

[11] 4,364,570

[45] Dec. 21, 1982

[54] ROPING TRAINING AID

[76] Inventor: Delbert W. Hallam, Rte. 1, Box 42, Evans, Wash. 99136

[21] Appl. No.: 248,565

[22] Filed: Mar. 27, 1981

[51] Int. Cl.[3] ..... A63B 69/00

[52] U.S. Cl. ..... 273/338; 273/407; 434/247

[58] Field of Search ..... 273/336, 337, 338, 339, 273/407; 434/247

[56] References Cited

U.S. PATENT DOCUMENTS 1,216,382 2/1917 Wenyon ..... 273/337

3,066,939 12/1962 Sprout ..... 273/338

*Primary Examiner*—Anton O. Oechsle

*Attorney, Agent, or Firm*—Wells, St. John & Roberts

[57] ABSTRACT

Retractable horns provided as an attachment to or integral with a hollow steer head roping dummy as an aid to allow a roper to practice roping a realistic target without requiring dismounting to retrieve the loop. The retractable horns are controlled by a lanyard actuator at a position remote from the training aid. A tug on the lanyard causes retraction of otherwise outwardly and horizontally projecting horns into the hollow steer head shaped housing to dislodge the lasso loop. A spring mechanism will cause the horns to move back to their normal operative positions once tension on the lanyard has been released.

11 Claims, 7 Drawing Figures

ROPING TRAINING AID

BACKGROUND OF THE INVENTION

The present invention relates to roping practice aids and particularly to such aids that have the capability of releasing a rope loop.

The western sport of team roping requires extensive practice. "Heading", for example, requires that the rider "header" throw a lasso loop from a fast moving horse over the horns of a fast running steer. Certain actions must immediately follow a successful roping effort. The header must jerk the rope tight to be sure of a horn catch. The rope must be "dallied" and the horse must be turned at an angle to the taut rope, holding it tight. Failure to do this often results in a time loss because the steer will not be positioned for the "heeler" or second roper who must catch the steer by one or both hind legs.

Actual "heading" roping practice requires use of a horse, a steer, and a large open area. This is not usually practical due to set up time, space requirements, and availability of good roping stock. Even with stock available, practice is tedious because the rider or an aid must disengage the loop from the steer's horns after each roping effort. Furthermore, soreness can develop at the base of the horns if a steer is roped too often. Horses can also be maltrained or overworked while the rider is merely practicing roping. It therefore becomes desirable to make use of a roping "dummy" and a sawhorse mounted to a saddle to safely and effectively practice throwing the "horn loop".

There are many variations of home made roping dummies, ranging from broomsticks embedded in hay bales to tripod mounted steer skulls. Commercial devices such as simulated steer heads made of rotation molded plastics are also in wide use. The hollow plastic heads are mountable to hay bales by anchor spikes.

The dummy is set up in a relatively open area where the roper can take position behind at a distance equivalent to that preferred during actual roping (usually 8 to 10 feet). Preferably a sawhorse and saddle are set up at this point so the roper can learn the proper roping technique from a saddle.

After the horn loop has been thrown, the header has several tasks that must follow in quick succession. These tasks should be practiced along with throwing of the horn loop.

During actual roping, as briefly alluded to above, the properly thrown horn loop must be pulled tight around the captured horns. This is done as the roper settles into the saddle from a standing throwing position and jerks the loop tight. This is done by pulling the rope down and back so the throwing hand swings rearwardly past the knee. This movement places the rope along the steer's back (hay bale) and will not flip the loop off the horns. The horse's reins must be held steady during this movement. Otherwise, the loop could be pulled askew and either miss the horns or complete an illegal catch. The rein hand should therefore be held steady as the slack is jerked.

After jerking the rope tight, the roper must then "dally" or wrap the free end of the rope arond the saddle horn and then "set" the steer in position for the heeler. "Setting" is done by abruptly slowing the horse and turning at an angle relative to the caught animal. The heeler then rides up to throw a loop around one or both of the steer's hind legs. On accomplishing this, the heeler manuevers his horse to pull the rope taut.

Team roping is typically a two rope event. That is to say, the header and heeler are each allowed to carry two ropes If one loop fails, a second can be thrown. It is therefore a good idea to practice roping in quick succession.

Known forms of roping dummies, including both commercial and homemade versions, have serious drawbacks, since the loop cannot be removed without assistance or unless the roper dismounts, collects the loop, and then remounts for the next throw. In fact, continuous roping practice, using two ropes, cannot be effectively practiced with dummies having fixed horns. It therefore becomes desirable to obtain a roping dummy that includes mechanism for releasing the loop after a successful throw.

U.S. Pat. No. 3,066,939 to D. E. Sprout discloses a roping dummy that includes a tripod mechanism by which a head and hinged horns can be secured to the ground. The device has freely pivoted horns that move from horizontal normal orientations to upright positions for releasing a lasso loop. The horns pivot about parallel axes on a head shaped frame between the two postions. There is no slide actuator for retracting the horns into the head shaped housing. Furthermore, there is no provision for automatically returning the horns to the normal horizontal positions as controlled by the roper. Instead, the horns return by gravity due to their cantilevered weight about the pivot axis. Tension applied along the length of the rope will cause the horns to swing upwardly and release the loop. This action can happen so quickly that it becomes difficult for the rider to tell whether or not he has completed a legal catch of both horns. The quick releasing action also precludes "dallying" practice.

The present roping training aid provides the unique feature of roper actuator retractable horns. The horns will retract in response to tension applied along the length of a long lanyard, held in the rein hand of the roper. The horns pivot upward and together while retracting into the head, assuring a clean, quick release of the loop when the roper so desires. This is done as the roper pulls on the lanyard, using the same motion used to rein in and turn the horse to "set" the steer for the heeler. The saddle mounted roper can "dally" just prior to releasing the loop because the horns will not retract until the lanyard is pulled. These features enable thorough practice of the complete roping sequence beyond the simple loop throwing practice facilitated by prior apparatus. Other distinct advantages will become evident from the accompanying description and attached drawings.

BRIEF DESCRIPTION OF A PREFERRED AND ALTERNATE EMBODIMENT

DETAILED DESCRIPTION

Figure 2:
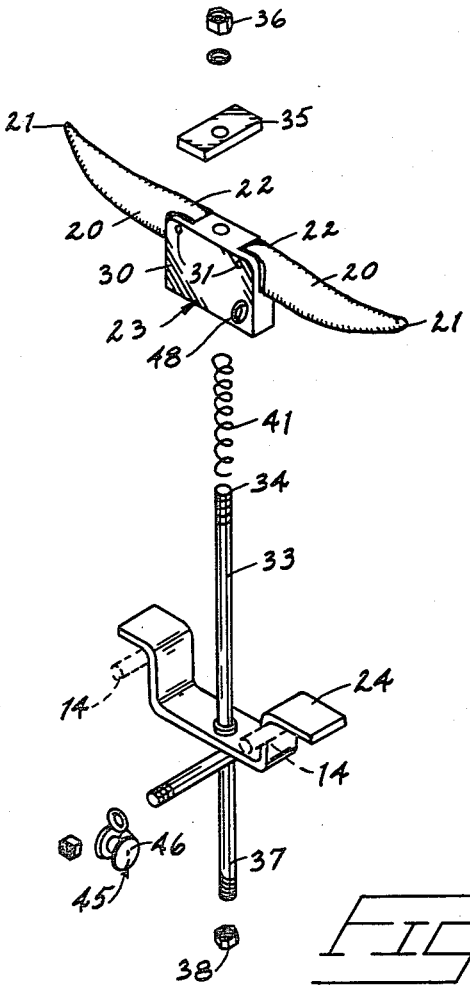
FIG. 2 is an exploded pictorial view of an attachment form of the present invention for modifying an existing roping dummy.
Figure 3:
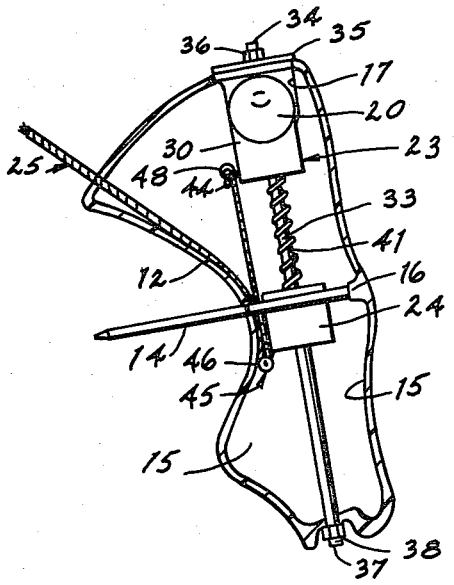
FIG. 3 is a vertical section view taken through a roping dummy with the attachment of FIG. 2 mounted thereto.
Figure 4:
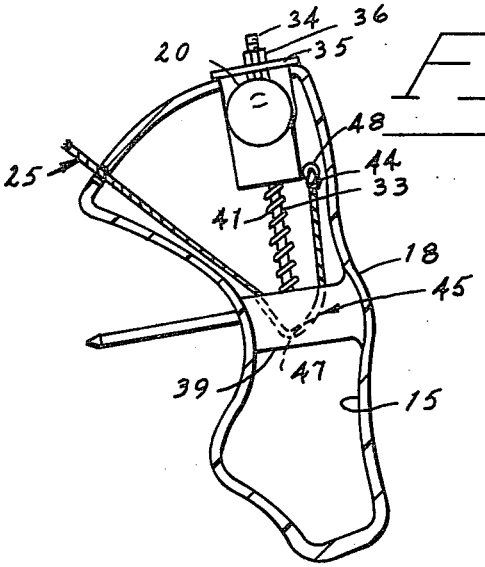
FIG. 4 is a sectional view similar to FIG. 3 only showing the present training aid as a complete unit manufactured with a head-shaped housing.
Figure 7:
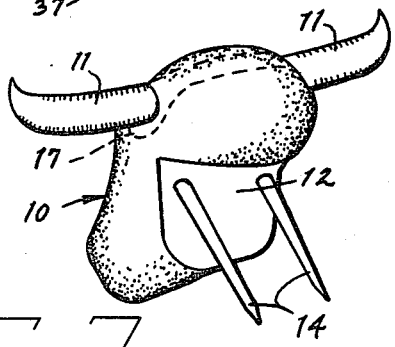
FIG. 7 is a view of a prior form of roping dummy capable of being altered to mount the attachment mechanisms shown in FIGS. 2 and 4.

Two basic forms of the present invention are illustrated in the accompanying drawings. The first form, illustrated in FIGS. 2 and 3, shows a form of the present invention that is adapted for attachment to an existing form of steer head-shaped roping dummy as shown in FIG. 7. The second form is shown in FIG. 4, wherein the components illustrated in FIG. 2 are produced along with the steer head-shape to be sold as a complete unit.

The training aid, as an attachment, mounts to an existing hollow steer head shaped roping dummy 10 as shown in FIG. 7. The dummy 10 typically includes integral horns 11 projecting horizontally and slightly upward in the same manner as actual steer horns. In fact, the external appearance of the steer head 10 is produced to strongly resemble an actual steer head, both in shape and size.

Figure 1:
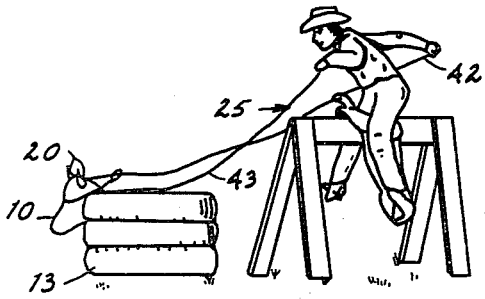
FIG. 1 is a diagrammatic view showing the present invention in use.

A rearward end of the dummy 10 includes an angular indentation 12. The indentation 12 is shaped to conform to the corner of a hay bale 13 as shown in FIG. 1. The dummy is anchored to the bale by rearwardly projecting spikes 14. The spikes can be imbedded in the hay to secure the dummy in place.

The hollow head of the standard dummy 10 is typically formed by rotation molding of selected plastics. This leaves a closed hollow interior 15 or cavity within the head. The horns may be either solid or hollow. Spike braces 16 are provided as reinforcing members within the hollow interior to mount the spikes 14.

The existing form of roping dummy 10 must be slightly modified to mount the attachment form of the present invention as shown in FIG. 2. To do this, the existing horns are removed, leaving a U-shaped recess 17 in the top of the head configuration and allowing access to the hollow interior 15.

The head configuration 18 as shown in FIG. 4 is intended to be produced especially for mounting the present retracting horn arrangements. The head, of this form, is produced without horns and includes special interior provisions for mounting the horn retracting components that will be discussed in greater detail below.

Both forms of the present invention make use of elongated rigid horns 20. The horns 20 include pointed ends 21 and enlarged, inward base ends 22. The horns 20 are mounted to an operator means 23 at their base ends for movement between substantially horizontal projecting operative positions (FIG. 5) and substantially vertical inoperative positions (FIG. 6). The attachment version is provided with a bracket or frame 24 on the operator means that is especially adapted to mount the operator means within the hollow interior 15 so the horns 20 will project outwardly when in their operative positions. The bracket also holds the operator means in position so the horns will be contained within the head interior 15 when in their inoperative positions.

The form of bracket 24 shown in FIG. 2 is not required when the horns and operator means are produced along with the hollow head 18. Instead, an integral projection 39 (FIG. 3) form of the bracket can be provided within the head 18 to support the operator means.

Figure 5:
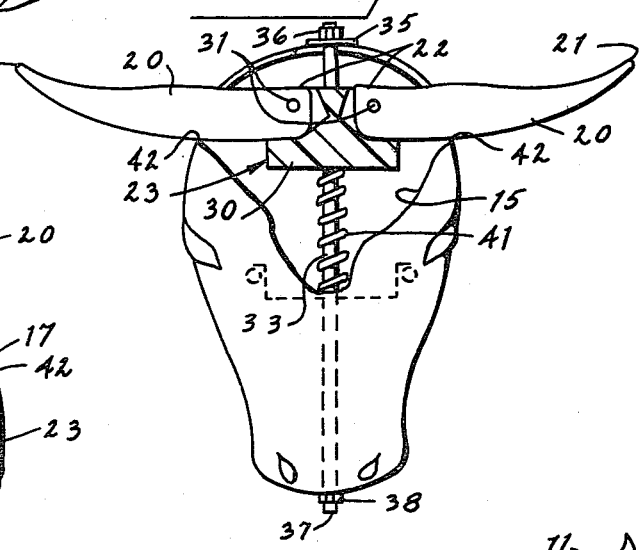
FIG. 5 is a frontal fragmentary view showing the horns in lowered, operative positions.
Figure 6:
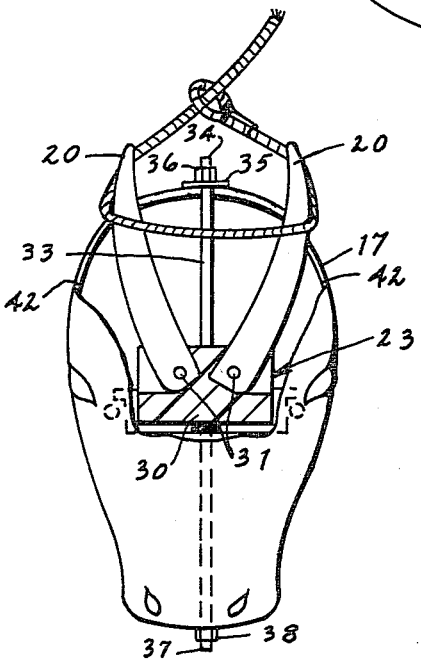
FIG. 6 is a view similar to FIG. 5, showing the horns in retracted, rope releasing inoperative position.

The operator means 23 is shown in substantial detail in FIGS. 3 through 5. It may be comprised of a carriage 30 pivotably mounting the base ends 22 of the horns 20. Pivot pins 31 extend through the horns and are attached to the carriage to define substantially parallel pivot axes for the horns. The pin axes are slightly inclined when the head is mounted to a bale as shown in FIG. 1.

The operator means also includes means for guiding the carriage in a straight translational movement between an extended position (FIG. 5) and a retracted position (FIG. 6). The extended position of the carriage corresponds to the horizontal operative positions of the horns, while the retracted position corresponds to the inoperative horn positions.

The guide means is preferably in the form of an elongated shaft 33, having an upper end 34 secured to the head by a horizontal mounting plate 35 and threadably attached nut 36. The lower end 37 of the shaft is connected by a nut 38 to a lower or muzzle end of the head-shaped housing.

Note in the complete assembly version (FIG. 4) that the shaft extends to the projection 39. Here, the lower shaft can be secured as an integral part of the projection or by other appropriate fastening devices.

The carriage 30 includes an upright central bore that is slidably received along the length of the shaft 33. The shaft will therefore guide the carriage along a path determined by the longitudinal shaft axis.

The carriage and pivotably attached horns are preferably urged toward the operative, extended positions by gravity and by means of a biasing spring 41. The spring 41 is received over the length of the shaft 33 between the bracket frame 24 on the attachment version or the projection 39 on the complete assembly with head 18. The biasing spring is an elongated compression spring that will continuously urge the carriage to its upper extended position.

It is noted that the action of the biasing spring 41 is separate from that of the pivotal motion for the horns 20. The horns pivot due to gravity to and from the operative and inoperative positions. When the carriage is being retracted, drawing the horns into the head interior 15, the lower surfaces of the horns ride against the cut out surfaces 42 of the head housing. These surfaces 42 cause the horns to cam upwardly and together about the axes of the pins. Conversely, when the carriage is elevated, the cantilevered weight of the horns causes them to simultaneously pivot outward in opposite direction while sliding across the engaged surfaces 42.

It is pointed out that the pivot axes for the horns are situated slightly elevationally above the centers of mass for the horns when in their operative positions. Placement of the pivot axes in such a relationship to the mass of the horns, prevents undesired free upward pivotal motion of the horns when they are properly roped. In fact, the primary rearward tension on the rope tends to be applied more around the head 10 or 18 at the bases for the horns. Little upward force is therefore applied that would otherwise tend to lift the horns.

An actuator means shown generally at 25 is connected to the operator means for causing the operator means to move the horns between the operative and inoperative positions. The actuator means 25 can be operated as shown in FIG. 1 from a position remote from the horns 20.

The actuator means 25, as shown in FIG. 1, includes an elongated lanyard 43 extending from the operator means 23 to the rein hand of the rider.

The lanyard 43 may be a convenient flexible cable or cord of sufficient length to extend from the head 10 or 18 to the rein hand of the roper. A free end 42 of the lanyard will thus be gripped in the roper's hand. The remaining end 44 extends into the hollow head interior 15 to connect with the operator means 23 by means generally indicated at 45.

Means 45 is provided to transmit pulling force along the length of the lanyard to the carriage, to cause motion of the horns toward the inoperative position. A pulley 46 may be used as one form of the means 45. The pulley 46 is affixed either to the bracket frame 24 or the shaft 33 to guide the lanyard upwardly to engagement with the operator means. The pulley could also be attached to the projection 39.

FIG. 4 shows means 45 as an integral channel or guide surface 47 formed within the projection 39. The smooth guide surface 47 will function in the same manner as the pulley 46. The pulley 46 and surface 47 serve the same purpose and are therefore functionally interchangeable.

A conventional eyelet 48 or other appropriate lanyard securing access may be provided on the carriage to attach the lanyard end 44. It is important that the eyelet 48 be substantially aligned along the axis of the shaft 33 from the pulley 46 or surface 47. The length of lanyard extending between the two is therefore substantially axial and can produce a pulling force only in an axial direction. Thus, a jerk or tug at the free end of the lanyard will produce a pulling force along the length of the lanyard between the surface 47 (or pulley 46) and the carriage. Such force will cause the bracket and attached horns to move along the axis of the guide shaft to the retracted, inoperative positions.

Both forms of the present invention described above operate in an identical manner. Prior to operation, the apparatus is attached, preferably to a bale of hay 13 in the manner shown in FIG. 1. The spikes 14 are imbedded in the hay to hold the head and horns in a natural position and at an elevation reasonably close to that of an actual running steer. The lanyard is then directed to a position behind the horns where the roper wishes to throw.

Of course, the present arrangement can be used both for mounted and dismounted roping practice. However, the present invention is especially useful in roping practice for the "header" roper of a steer roping team. In such practice, it is preferred that the rider be positioned in a saddle at an elevation above and rearward of the horns at a desired roping distance. This distance is typically between eight and ten feet and preferably in the vicinity of eight feet. The roper can then mount the saddle as shown in FIG. 1, and ready for the throw. The roper preferably stands in the stirrups of the saddle to assure clear vision of the target horns. The loop is thrown from this position. If the loop has been properly thrown, the rider will quickly settle onto the saddle and, in the same motion, jerk the rope to securely catch the horns within the loop. The jerking motion is accomplished by grasping the rope in the throwing hand and moving the hand in a down and backward arc past the knee and back upwardly past the shoulder as shown in FIG. 1. This motion assures that the loop will be pulled at a relatively shallow angle (nearly horizontally) so the loop will not drop below the muzzle area of the head.

When the loop is secured around the horns, the rider can either pull the lanyard to release the loop, or continue with further practice facilitated by the present arrangement.

After securing the loop, the rider can practice "dallying". In doing this the free end of the rope is turned one or more times about the saddle horn. The horns 20 during this time will remain in the operative position and will not allow the loop to slip free. Considerable tension can be applied along the rope to the saddle horn without causing the horns to pivot up to the inoperative, loop releasing positions.

The lanyard is preferably held in the rein hand. It is operable at any time by the rider. However, it may be desirable to hold the lanyard in a somewhat taut condition. Excessive, undesired movement of the rein hand will therefore be detected by corresponding movement of the horns. For example, if the rein hand is moving involuntarily to rein the horse in and "set" the steer prior to dallying, the roper will know because the rein hand will pull the lanyard, causing the horns to retract before the actual time for "setting" is required. The roper can therefore train himself not only in rope throwing technique, but also in proper coordination and timing for handling the horse that is so essential with fast "heading" in competition.

When tension is finally properly applied along the length of the lanyard, the horns will pivot upwardly and retract into the head as shown in FIG. 6. This motion frees the rope loop quickly and easily so the roper does not have to dismount. Repeated roping throws can be completed in quick succession through use of the lanyard and the horn control mechanisms described.

Having thus described my invention, what I claim is:

1. A retractable horn attachment for hollow steer head-shaped roping dummies, comprising:

a pair of horns, each having an inner base end and a remote outer end;

a carriage pivotally mounting the horns at their base ends for movement between horizontal oppositely projecting operative positions and substantially vertical inoperative positions;

guide means movably mounting the carriage and adapted to be mounted within a hollow steer head-shaped roping dummy for movement of the carriage between an extended position corresponding to the operative horn positions wherein the horns are extended from the hollow steer head-shaped roping dummy, and a retracted position corresponding to the inoperative horn positions wherein the horns are retracted into the hollow roping dummy; and actuator means connected with the carriage and operable from a remote location for selectively causing the horns to move between their extended operative positions and their retracted inoperative positions.

2. The invention as claimed by claim 1 further comprising biasing means for yieldably urging the carriage to the extended position and for yieldably resisting motion of the carriage toward the retracted position.

3. The invention as claimed in claim 1 wherein the actuator means includes an elongated lanyard; and means interconnecting one end of the lanyard with the carriage so a pulling force along the lanyard will cause motion of the horns toward their inoperative positions.

4. The invention as claimed by claim 3 wherein the one end of the lanyard is attached to the carriage and wherein the means interconnecting the one lanyard end with the carriage is comprised of a pulley mounted to the guide means adjacent the retracted position of the carriage.

5. The invention as claimed by claim 1 wherein the base ends of the horns pivot about axes that are situated elevationally above the center of mass for the horns when the horns are in their operative positions.

6. A roping training aid, comprising:

a hollow, steer head-shaped housing:

a pair of horns each having an outer pointed end and an inner base end;

a carriage mounting the base ends of the horns for pivotal movement between horizontal outwardly projecting operative positions and vertical inoperative positions;

guide means mounting the carriage for movement within the housing between an extended position corresponding to the operative horn positions with the horns extending horizontally outward, and a retracted position corresponding to the inoperative horn positions, with the horns retracted into the housing; and actuator means connected to the carriage and operable from a remote position for causing the carriage and horns to move between their extended operative positions and their retracted inoperative positions.

7. The invention as claimed in claim 6 further comprising biasing means for yieldably urging the carriage to the extended position and for yieldably resisting motion of the carriage toward the retracted position.

8. The invention as claimed by claim 6 wherein the actuator means includes an elongated lanyard; and means interconnecting one end of the lanyard with the carriage so a pulling force along the lanyard will cause motion of the horns toward their inoperative positions and movement of the carriage from the extended position toward the retracted position.

9. The invention as claimed by claim 8 wherein the one end of the lanyard is attached to the carriage and wherein the means interconnecting the one lanyard end with the carriage is comprised of a guide surface on the guide means adjacent the retracted position of the carriage.

10. The invention as claimed by claim 6 wherein the base ends of the horns pivot about axes that are situated elevationally above the centers of mass for the horns when the horns are in their operative positions.

11. A roping training aid for providing roper actuated retractable horns in a roping practice dummy, the dummy being in the form of a hollow housing shaped like a steer head, having reinforcing members spanning the hollow interior thereof; said aid comprising:

a pair of horns, each having a pointed outside end and a base end;

a carriage mounting the horns for pivotal movement about axes at the base ends thereof between operative positions wherein the pointed outside ends are substantially horizontal and inoperative positions wherein the horns are substantially vertical with the pointed outside ends close together;

guide means mounting the carriage for translational motion along a prescribed, substantially vertical path from a first position to a second position;

biasing means operatively engaging the carriage for yieldably resisting movement of the carriage toward the second position and for automatically returning the carriage to the first position from the second position;

a frame adapted to be secured to the reinforcing members of the hollow housing, mounting the guide means and carriage within the housing so the horns will protrude substantially horizontally therefrom when in their operative positions, and so the horns will be substantially contained within the housing when in the inoperative positions, with the carriage in the second position; and actuator means connected to the carriage and adapted to be remotely operated, for selectively shifting the carriage from its first position to its second position thereof.

* * * * *